US009220382B2

(12) United States Patent
Liu

(10) Patent No.: US 9,220,382 B2
(45) Date of Patent: Dec. 29, 2015

(54) AUTO-SENSING HAND DRYER

(71) Applicant: HOKWANG INDUSTRIES CO., LTD., New Taipei (TW)

(72) Inventor: Shen-Chen Liu, New Taipei (TW)

(73) Assignee: HOKWANG INDUSTRIES CO., LTD., New Taipei (TW)

( * ) Notice: Subject to any disclaimer, the term of this patent is extended or adjusted under 35 U.S.C. 154(b) by 137 days.

(21) Appl. No.: 14/098,436

(22) Filed: Dec. 5, 2013

(65) Prior Publication Data

US 2015/0159951 A1 Jun. 11, 2015

(51) Int. Cl.

| | |
|---|---|
| ***F26B 21/12*** | (2006.01) |
| ***A47K 10/48*** | (2006.01) |
| *A47K 10/36* | (2006.01) |

(52) U.S. Cl.

CPC ..... *A47K 10/48* (2013.01); *A47K 2010/3668* (2013.01)

(58) Field of Classification Search

CPC ..... F26B 19/00; F26B 21/00; F26B 21/12; F24H 3/00; F24H 3/02; A24J 27/00; A24J 10/48; A47K 10/48

USPC ..... 34/105, 201; 392/380, 384, 385

See application file for complete search history.

(56) References Cited

U.S. PATENT DOCUMENTS

| | | | | |
|---|---|---|---|---|
| 5,186,360 | A | 2/1993 | Mease et al. | |
| 5,459,944 | A * | 10/1995 | Tatsutani et al. | 34/202 |
| 8,037,619 | B2 * | 10/2011 | Liu | 34/218 |
| 8,064,756 | B2 * | 11/2011 | Liu | 392/380 |
| 8,155,508 | B2 * | 4/2012 | Caine et al. | 392/380 |
| D661,023 | S * | 5/2012 | Liu et al. | D28/54.1 |
| 8,341,853 | B2 * | 1/2013 | French et al. | 34/90 |
| 8,347,521 | B2 * | 1/2013 | Churchill et al. | 34/82 |
| 8,347,522 | B2 * | 1/2013 | Dyson et al. | 34/90 |
| 8,490,291 | B2 * | 7/2013 | Churchill et al. | 34/90 |
| 8,813,383 | B2 * | 8/2014 | Liu et al. | 34/90 |
| 8,850,713 | B2 * | 10/2014 | Nakamura et al. | 34/90 |
| 2013/0055588 | A1 * | 3/2013 | Nakamura et al. | 34/565 |

FOREIGN PATENT DOCUMENTS

| | | | | |
|---|---|---|---|---|
| CA | 2363744 | A1 * | 5/2003 | |
| DE | 102011050300 | A1 * | 11/2012 | |
| JP | 01075735 | A * | 3/1989 | E03C 1/05 |
| TW | I326207 | | 5/2009 | |
| WO | WO 9953250 | A1 * | 10/1999 | F26B 3/34 |

* cited by examiner

*Primary Examiner* — Stephen M Gravini

(74) *Attorney, Agent, or Firm* — Muncy, Geissler, Olds & Lowe, P.C.

(57) ABSTRACT

An auto-sensing hand dryer includes an airflow generating device, a guiding duct connected to the airflow generating device, and a sensing unit disposed in the guiding duct. The airflow generating device generates a hand drying airflow. The guiding duct includes a connecting portion communicating with the airflow generating device, an air outlet portion communicating with the connecting portion. The air outlet portion comprises an air discharge opening and a housing encircling the air discharge opening and forming an internal space. The sensing unit is disposed in the internal space and electrically connected to the airflow generating device to determine whether to generate the hand drying airflow. The sensing unit includes a sensing region at least covering the air discharge opening. When a user hand is placed at the air discharge opening, the sensing unit senses the user hand and drives the airflow generating device to generate the hand drying airflow.

7 Claims, 4 Drawing Sheets

AUTO-SENSING HAND DRYER

FIELD OF THE INVENTION

The present invention relates to an auto-sensing hand dryer, and particularly to an auto-sensing hand dryer including a sensing unit having a sensing region covering an air discharge opening of the auto-sensing hand dryer.

BACKGROUND OF THE INVENTION

Hygienics in the daily life continues to draw more attention as humanities improve. For one, hygienics is particularly valued in public restrooms. To quickly remove residual water from hands after washing hands, paper towels for wiping hands are usually offered in public restrooms. However, such paper towels that are disposed after one-time use do not meet green requirements of the world today. As a result, hand dryers that can be used to replace paper towels are widely provided in public restrooms.

With the progress of infrared sensors, technologies for driving a hand dryer through sensing hands of a user by an infrared sensor have been developed. For example, the Taiwan Patent I326207 discloses "Dehumidified Hand Dryer". The disclosed hand dryer includes a hand drying device, a dehumidifying device and a temperature control device. The hand drying device includes a hollow casing, a heater, an airflow inlet fan, and an airflow outlet fan. The dehumidifying device includes a first thermoelectric module and a second thermoelectric module. The temperature control device is mounted on the hollow casing, powers the hand drying device and the dehumidifying device, and controls hand drying and temperature control operations in an ambient environment. The temperature control device includes a control circuit board, an infrared sensor, a power switch button, and a forced stop button. When the infrared sensor senses that hands are placed into a lower part of an airflow discharge opening, the airflow inlet fan is activated and the airflow outlet fan starts rotating at a high speed. A heated airflow at an airflow duct is discharged out of the airflow discharge opening to achieve an effect of hand drying. For another example, the U.S. Pat. No. 5,186,360 discloses "Automatic Soap Dispenser and Hand Drying Unit". In the above patent, the automatic soap dispenser and hand drying unit include a housing. The housing encloses an automatic soap dispenser at an upper portion thereof, and an automatic hand dryer at a lower portion thereof. An infrared sensor is further included at the lower portion of the housing, and is disposed at a vertical wall surface of a front portion of the housing. The airflow discharge opening of the automatic hand dryer is disposed at an angle relative to the infrared sensor, which detects hands of a user and enables the hand dryer to automatically output a hand drying airflow.

The above dehumidifying hand dryer and automatic soap dispenser and hand drying unit disclosed both include a hand dryer installed with an infrared sensor, with however a distance existing between the infrared sensor and the airflow discharge opening of the hand dryer. When a user intuitively places hands near the airflow discharge opening, the infrared sensor offers inadequate sensing capability for sensing the hands of the user due to the abovementioned distance, in a way that the hand dryer is not driven and fails to provide a hand drying airflow. Further, as the hands of the user need to move back and forth near the airflow discharge opening in order to drive the infrared sensor to perform the corresponding sensing operation, the usage such hand dryer is made quite inconvenient.

SUMMARY OF THE INVENTION

Therefore the primary object of the present invention is to provide an auto-sensing hand dryer that effectively senses hands of a user and thereby provides a hand drying airflow.

To achieve the above object, an auto-sensing hand dryer is provided by the present invention. The auto-sensing hand dryer includes an airflow generating device, a guiding duct and a sensing unit. The airflow generating device generates a hand drying airflow. The guiding duct includes a connecting portion in communication with the airflow generating device and for obtaining the hand drying airflow, an air outlet portion in communication with the connecting portion, guiding and discharging the hand drying airflow and including an air discharging opening, and a housing encircling the air discharge opening and forming an internal space. The sensing unit is disposed in the internal space, and is electrically connected to the airflow generating device to determine whether the airflow generating device is to generate the hand drying airflow. The sensing unit includes a sensing region at least covering the air discharge opening.

In one embodiment of the present invention, the airflow generating device includes an air blower for generating the hand drying airflow.

In one embodiment of the present invention, the sensing unit includes a conductive wire arranged along the guiding duct and connected to the airflow generating device.

In one embodiment of the present invention, the internal space includes an installation portion for installing the sensing unit, and an air inlet portion between the installing portion and the air discharge opening and connected to the connecting portion.

In one embodiment of the present invention, the sensing unit includes a sensor that detects thermal radiation and thus generates a sensing signal, and a control circuit electrically connected to the airflow generating device and the sensor and for driving the airflow generating device when driven by the sensing signal.

In one embodiment of the present invention, the sensor is an infrared sensor.

In one embodiment of the present invention, the guiding duct includes a nozzle disposed at the air discharge opening.

With the above structure of the present invention, the present invention is characterized by the following features. In the auto-sensing hand dryer of the present invention, the sensing unit is disposed in the guiding duct, and the sensing unit includes a sensing region that at least covers the air discharge opening. However, in a conventional auto-sensing hand dryer, due to a distance between the air discharge opening and the infrared sensor, the infrared sensor offers inadequate sensing capability for sensing the hands of the user. As such, the hand dryer is not driven and the hand drying airflow cannot be provided, and the hands of the user need to further move back and forth near the airflow discharge opening in order to drive the infrared sensor to perform the corresponding sensing operation. Therefore, the auto-sensing hand dryer of the present invention is capable of solving the inadequate sensing capability of the infrared sensor for driving the hand dryer.

Further, in the auto-sensing hand dryer of the present invention, the connecting portion and the air outlet portion of the guiding duct are utilized to guide the hand drying airflow, so that the air discharge opening for the hand drying airflow is kept away from the airflow generating device of the auto-sensing hand dryer. Moreover, the guiding duct of the auto-sensing hand dryer may be disposed on a platform of a wash-basin, and a user may thus directly blow dry his/her hands after washing hands.

DETAILED DESCRIPTION OF THE PREFERRED EMBODIMENTS

Figure 1:
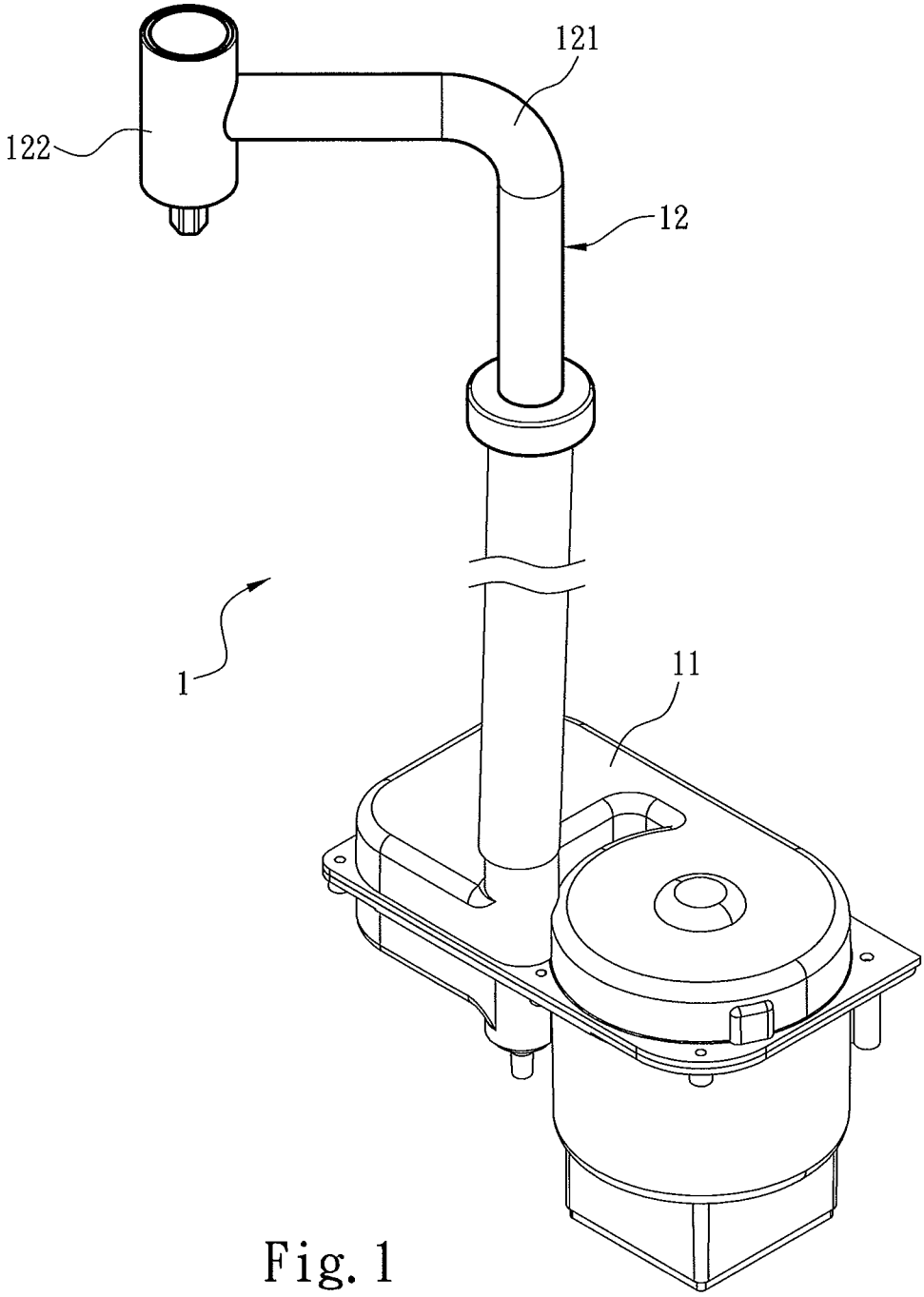
FIG. 1 is a schematic diagram of an auto-sensing hand dryer of the present invention.
Figure 2:
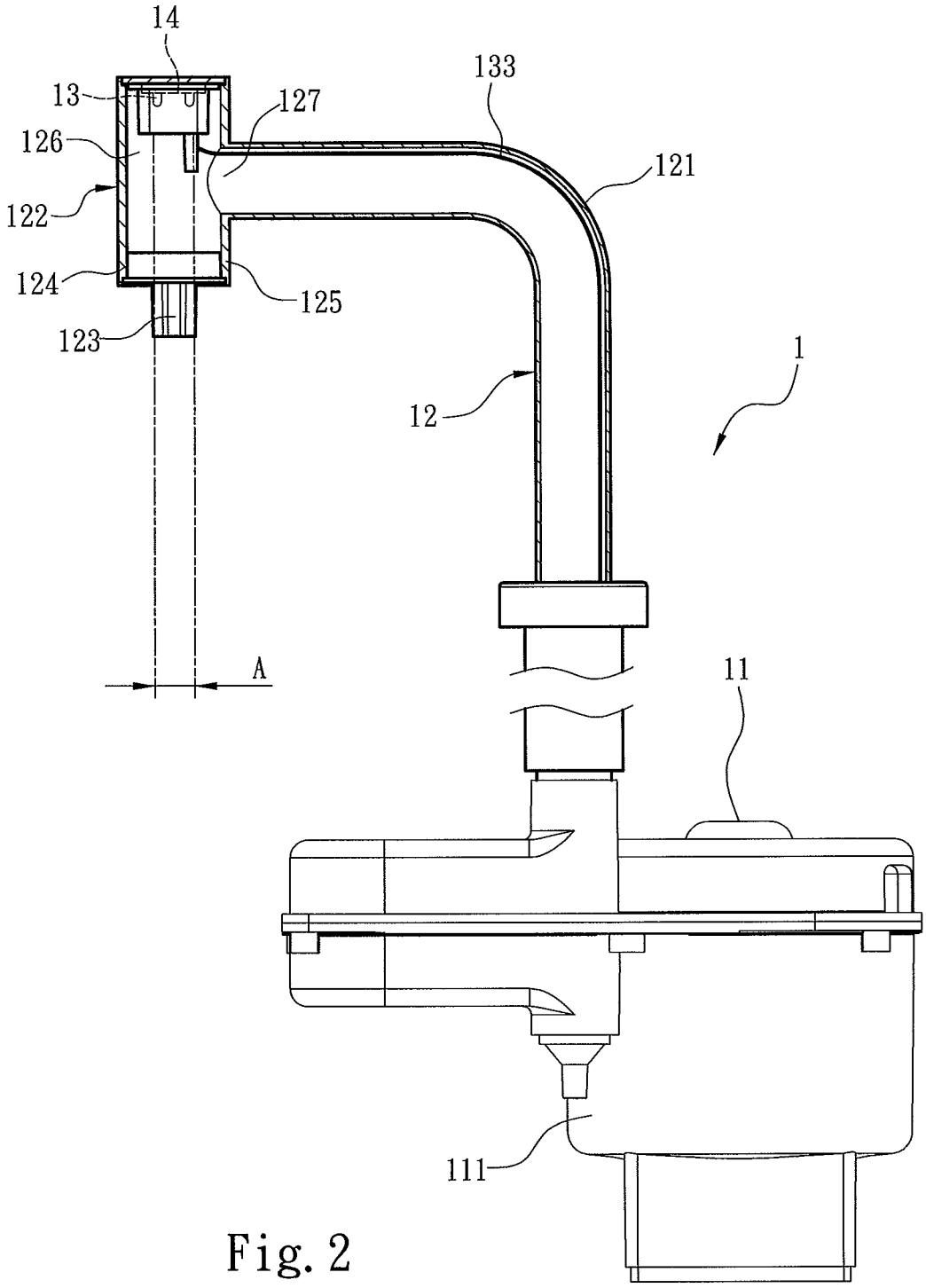
FIG. 2 is a partial sectional view of an auto-sensing hand dryer of the present invention.
Figure 4:
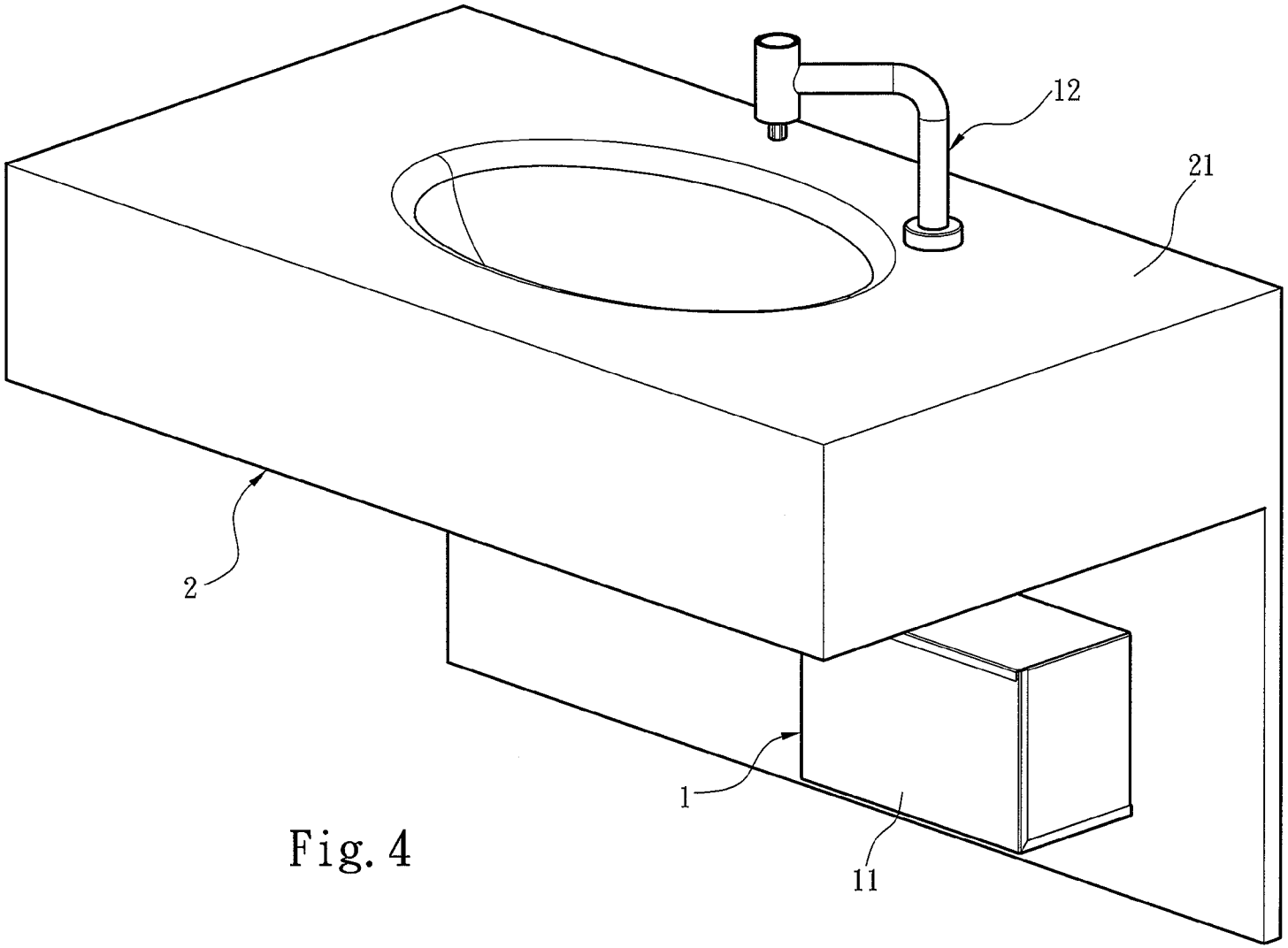
FIG. 4 is a schematic diagram of an auto-sensing hand dryer according to an embodiment of the present invention.

Referring to FIGS. 1 and 2, an auto-sensing hand dryer 1 of the present invention includes an airflow generating device 11, a guiding duct 12 connected to the airflow generating device 11, and a sensing unit 13 disposed in the guiding duct 12 and electrically connected to the airflow generating device 11. The airflow generating device 11 generates a hand drying airflow. The guiding duct 12 obtains the hand drying airflow from the airflow generating device 11 and guides a direction of the hand drying airflow. The sensing unit 13 detects a user hand to determine whether the airflow generating device 11 is to generate the hand drying airflow. Referring to FIG. 4, in the embodiment, the airflow generating device 11 of the auto-sensing hand dryer 1 is disposed below a washbasin 2, and the guiding duct 12 connected to the airflow generating device 11 may be connected to a platform 21 of the washbasin 2 from below the washbasin 2.

Figure 3:
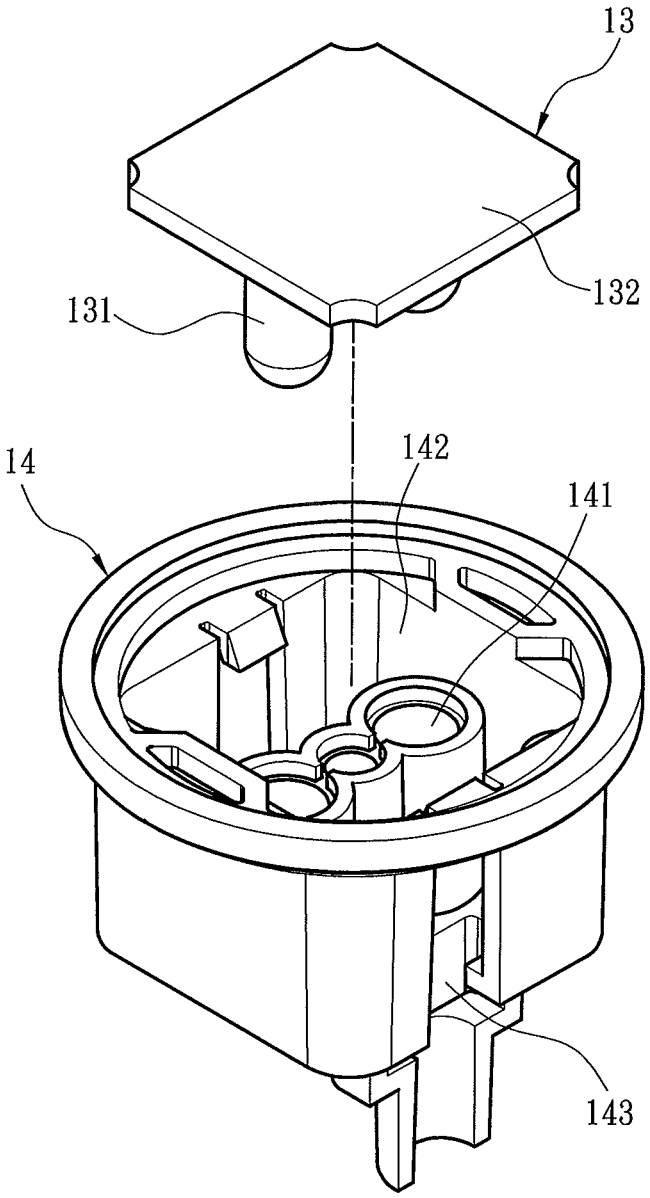
FIG. 3 is a schematic diagram of a sensing unit and an installation portion of an auto-sensing hand dryer of the present invention.

Referring to FIGS. 2 and 3, in the embodiment, the airflow generating device 11 includes an air blower 111 that generates a high-temperature hand drying airflow. The guiding duct 12 includes a connecting portion 121, an air outlet portion 122 connected to the connecting portion 121, and a nozzle 123 disposed at the air outlet portion 122 and for increasing an output speed of the hand drying airflow. The air outlet portion 122 includes an air discharge opening 124, a housing 125 encircling the air discharge opening 124, and an internal space 126 located in the housing 125. The air outlet portion 122 includes an installation portion 14 disposed in the internal space 126 and for installing the sensing unit 13, and an air inlet portion 127 located between the installation portion 14 and the air discharge opening 124 and connected to the connecting portion 121. The sensing unit 13 includes a sensor 131, a control circuit 132 electrically connected to the sensor 131 and the airflow generating device 11, and a conductive wire 133 electrically connected to the control circuit 132 and the airflow generating device 11. The conductive wire 133 may be arranged along the air outlet portion 122 of the guiding duct 12 to become electrically connected to the airflow generating device 11. In the embodiment, for example, the sensor 131 is an infrared sensor that detects thermal radiation emitted from a human body and thus generates a sensing signal. The sensing unit 13 includes a sensing region A, which is triggered upon detecting a user and drives the airflow generating device 11 to generate the hand drying airflow. The installation portion 14 includes an accommodating hole 141 for installing the sensor 131, an accommodating recess 142 connected with the accommodating hole 141 and for installing the control circuit 132, and a fastening portion 143 connected with the accommodating recess 142 and for fastening the conductive wire 133.

To better understand operations of the present invention, details of how the sensing unit 13 of the auto-sensing hand dryer 1 detects a user hand and controls the activation and deactivation of the airflow generating device 11 for outputting or terminating the hand drying airflow are described below. The sensor 13 is disposed at the installation portion 14, the installation portion 14 is disposed in the internal space 126 relative to the air discharge opening 125, and the air inlet portion 127 is disposed between the air discharge opening 124 and the installation portion 14. Therefore, even when the sensing unit 13 is installed in the air outlet portion 122 of the guiding duct 12, the position at which the sensing unit 13 is installed leaves the transportation of the hand drying airflow unaffected. When the user places a hand at the air discharge opening 124, i.e., places a hand in the sensing region A, the sensor 13 detects the thermal radiation emitted from the hand and thus generates the sensing signal. The control circuit 132 receives the sensing signal to further drive the airflow generating device 11, which then generates the hand drying airflow. The guiding duct 12 connected with the airflow generating device 11 guides the hand drying airflow. The hand drying airflow is transported through the connecting portion 121 of the guiding duct 12 to the air outlet portion 122. Further, after the connecting portion 122 of the guiding duct 12 receives the hand drying airflow from the airflow generating device 11, the air outlet portion 12 next receives the hand drying airflow from the connecting portion 121 via the air inlet portion 127 connected with the connecting portion 121. The hand drying airflow then passes from the internal space 126 of the air outlet portion 122 to the air discharge opening 124 and is discharged from the nozzle 123. Thus, the user may dry hands using the hand drying airflow.

In conclusion, in the present invention, the sensing unit is disposed in the guiding duct, and the sensing unit includes a sensing region that at least covers the air discharge opening. Compared to a conventional hand dryer, in which a hand dryer is not driven and the hand drying airflow cannot be provided due to a distance between the air discharge opening and the infrared sensor, the issues that the infrared sensor provides inadequate sensing capability and the hands of the user need to move back and forth near the airflow discharge opening in order to drive the infrared sensor to perform the corresponding sensing operation are eliminated.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An auto-sensing hand dryer, comprising:

an airflow generating device for generating a hand drying airflow;

a guiding duct comprising a connection portion in communication with the airflow generating device and for obtaining the hand drying airflow, an air outlet portion communicating with the connecting portion for guiding and discharging the hand drying airflow and comprising an air discharge opening, and a housing encircling the air discharge opening and forming an internal space; and a sensing unit disposed in the internal space and electrically connected to the airflow generating device for determining whether the airflow generating device is to generate the hand drying airflow, the sensing unit comprising a sensing region at least covering the air discharge opening.

2. The auto-sensing hand dryer of claim 1, wherein the airflow generating device comprises an air blower for generating the hand drying airflow.

3. The auto-sensing hand dryer of claim 1, wherein the sensing unit comprises a conductive wire arranged along the guiding duct and electrically connected to the airflow generating device.

4. The auto-sensing hand dryer of claim 1, wherein the internal space includes an installation portion for installing the sensing unit and an air inlet portion located between the installation portion and the air discharge opening and connected to the connecting portion.

5. The auto-sensing hand dryer of claim 1, wherein the sensing unit comprises a sensor for detecting thermal radiation and generating a sensing signal, and a control circuit electrically connected to the airflow generating device and receiving the sensing signal to drive the airflow generating device.

6. The auto-sensing hand dryer of claim 1, wherein the sensor is an infrared sensor.

7. The auto-sensing hand dryer of claim 1, wherein the guiding duct comprises a nozzle disposed at the air discharge opening.

* * * * *